US005300001A

United States Patent [19]

Sealy

[11] Patent Number: 5,300,001

[45] Date of Patent: Apr. 5, 1994

[54] PORTABLE DUMBBELL APPARATUS

[76] Inventor: Anthony J. Sealy, 1512 S. 26th St., Philadelphia, Pa. 19146

[21] Appl. No.: 55,290

[22] Filed: May 3, 1993

[51] Int. Cl.[5] ..... A63B 11/00

[52] U.S. Cl. ..... 482/108; 482/106; 128/DIG. 15

[58] Field of Search ..... 128/157, DIG. 15, 165; 482/108, 106, 105, 92, 148, 93, 109, 124, 126

[56] References Cited

U.S. PATENT DOCUMENTS

| | | | |
|---|---|---|---|
| D. 254,214 | 2/1980 | Leary | 128/DIG. 15 |
| 3,231,270 | 1/1966 | Winer | 482/105 |
| 3,334,899 | 8/1967 | Bosko et al. | 482/108 |
| 3,789,842 | 2/1974 | Froimson | 128/DIG. 15 |
| 4,627,618 | 12/1986 | Schwartz | 482/106 |
| 4,695,051 | 9/1987 | Jenison | 482/108 |
| 4,854,575 | 8/1989 | Wilson et al. | 482/108 |
| 4,854,576 | 8/1989 | McWain | 482/106 |
| 4,905,992 | 3/1990 | McWain | 482/106 |
| 5,072,935 | 12/1991 | McWain | 482/105 |
| 5,090,693 | 2/1992 | Liang | 482/108 |

*Primary Examiner*—Richard J. Apley
*Assistant Examiner*—Jerome Donnelly
*Attorney, Agent, or Firm*—Leon Gilden

[57] ABSTRACT

A dumbbell structure arranged for compacted configuration for ease of storage and transport is provided, wherein each dumbbell of the dumbbell apparatus includes respective first and second cylindrical housings having accordion pleated flexible side walls interconnected by an intermediate tubular housing, wherein each dumbbell is arranged for expansion for filling with dense material such as sand or fluid in use through a fill conduit in the first cylindrical housing of each dumbbell. The structure is arranged to further include a support web having a resilient central core to afford rigidity to the tubular housing when mounted thereabout.

3 Claims, 4 Drawing Sheets

PORTABLE DUMBBELL APPARATUS

BACKGROUND OF THE INVENTION

1. Field of the Invention

The field of invention relates to dumbbell apparatus, and more particularly pertains to a new and improved portable dumbbell apparatus wherein the same is arranged for compaction and expansion relative to respective periods of storage and use.

2. Description of the Prior Art

Dumbbell apparatus of various types have been utilized throughout the prior art, wherein such structure is exemplified in U.S. Pat. No. 4,566,690 to Schook wherein a rigid dumbbell member includes threadedly securable members arranged for mounting to each end of the dumbbell for enhanced weighting of the dumbbell structure.

The instant invention attempts to overcome deficiencies of the prior art by employing a dumbbell structure arranged for compaction that may be expanded to accommodate various material to effect weighting of the dumbbell structure and in this respect, the present invention substantially fulfills this need.

SUMMARY OF THE INVENTION

In view of the foregoing disadvantages inherent in the known types of dumbbell apparatus now present in the prior art, the present invention provides a portable dumbbell apparatus wherein the same is arranged for expansion and contraction relative to the accommodation of various components to be directed into the dumbbell structure, such as gravel and fluid. As such, the general purpose of the present invention, which will be described subsequently in greater detail, is to provide a new and improved portable dumbbell apparatus which has all the advantages of the prior art dumbbell apparatus and none of the disadvantages.

To attain this, the present invention provides a dumbbell structure arranged for compacted configuration for ease of storage and transport, wherein each dumbbell of the dumbbell apparatus includes respective first and second cylindrical housings having accordion pleated flexible side walls interconnected by an intermediate tubular housing, wherein each dumbbell is arranged for expansion for filling with dense material such as sand or fluid in use through a fill conduit in the first cylindrical housing of each dumbbell. The structure is arranged to further include a support web having a resilient central core to afford rigidity to the tubular housing when mounted thereabout.

My invention resides not in any one of these features per se, but rather in the particular combination of all of them herein disclosed and claimed and it is distinguished from the prior art in this particular combination of all of its structures for the functions specified.

It is therefore an object of the present invention to provide a new and improved portable dumbbell apparatus which has all the advantages of the prior art dumbbell apparatus and none of the disadvantages.

It is another object of the present invention to provide a new and improved portable dumbbell apparatus which may be easily and efficiently manufactured and marketed.

It is a further object of the present invention to provide a new and improved portable dumbbell apparatus which is of a durable and reliable construction.

An even further object of the present invention is to provide a new and improved portable dumbbell apparatus which is susceptible of a low cost of manufacture with regard to both materials and labor, and which accordingly is then susceptible of low prices of sale to the consuming public, thereby making such portable dumbbell apparatus economically available to the buying public.

Still yet another object of the present invention is to provide a new and improved portable dumbbell apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
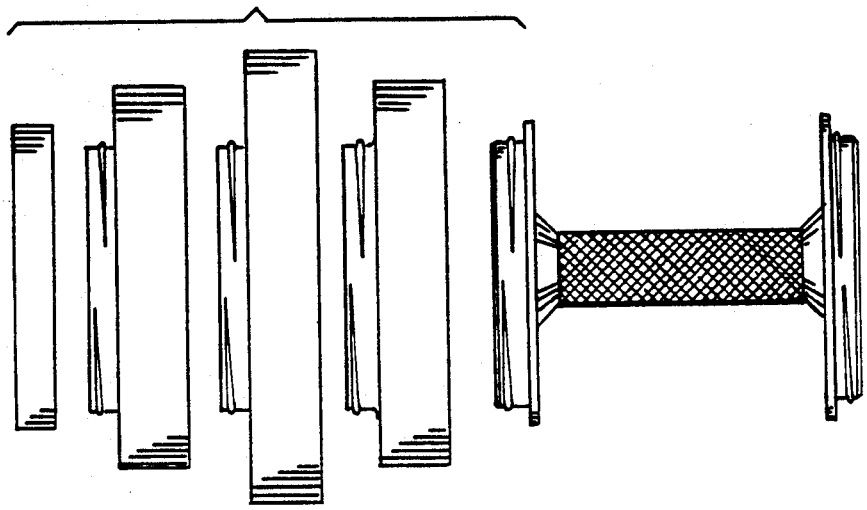
FIG. 1 PRIOR ART
FIG. 1 is an orthographic view of a prior art stacked weight construction, as indicated in U.S. Pat. No. 4,566,690.

With reference now to the drawings, and in particular to FIGS. 1 to 8 thereof, a new and improved portable dumbbell apparatus embodying the principles and concepts of the present invention and generally designated by the reference numerals 10 and **10*a*** will be described.

Figure 2:
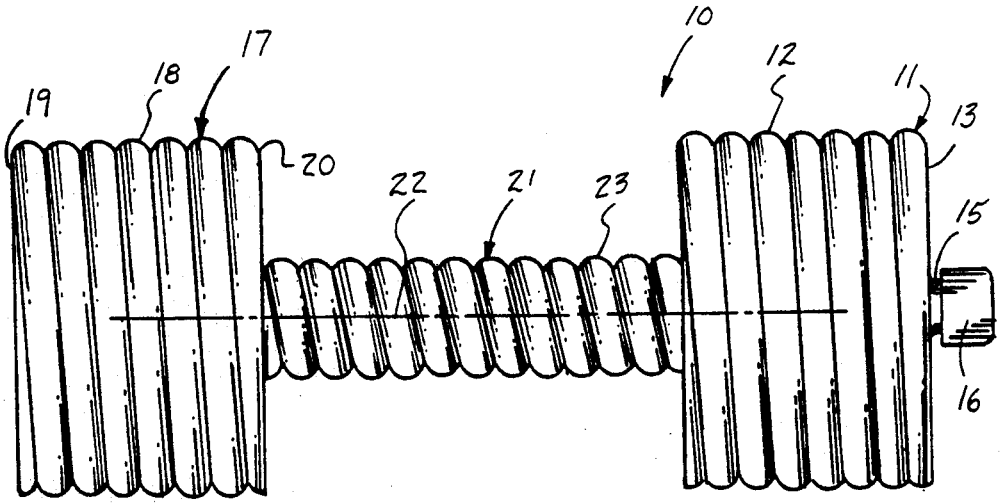
FIG. 2 is an orthographic view of an individual dumbbell of the apparatus of the invention.
Figure 3:
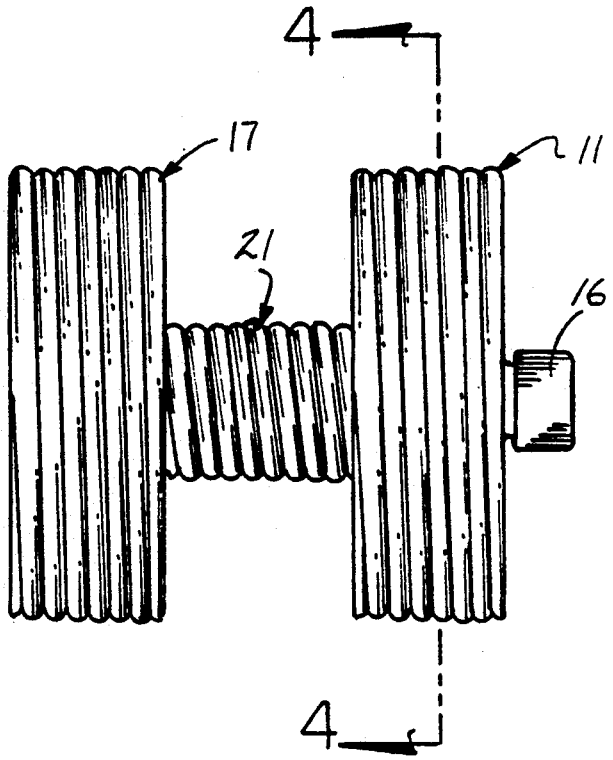
FIG. 3 is an orthographic view of the invention arranged in compacted configuration.
Figure 4:
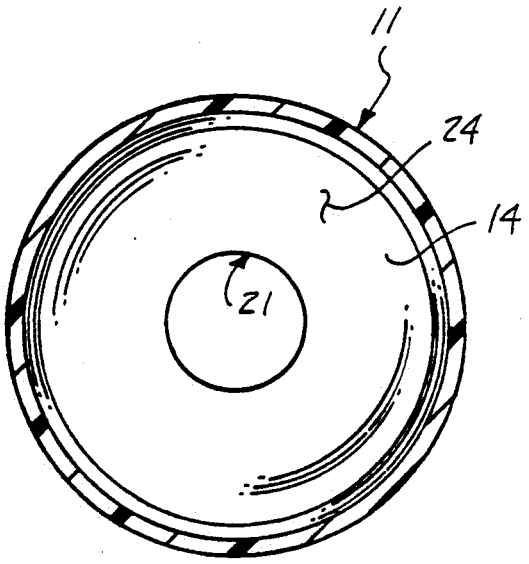
FIG. 4 is an orthographic view, taken along the lines 4—4 of FIG. 3 in the direction indicated by the arrows.
Figures 5, 6:
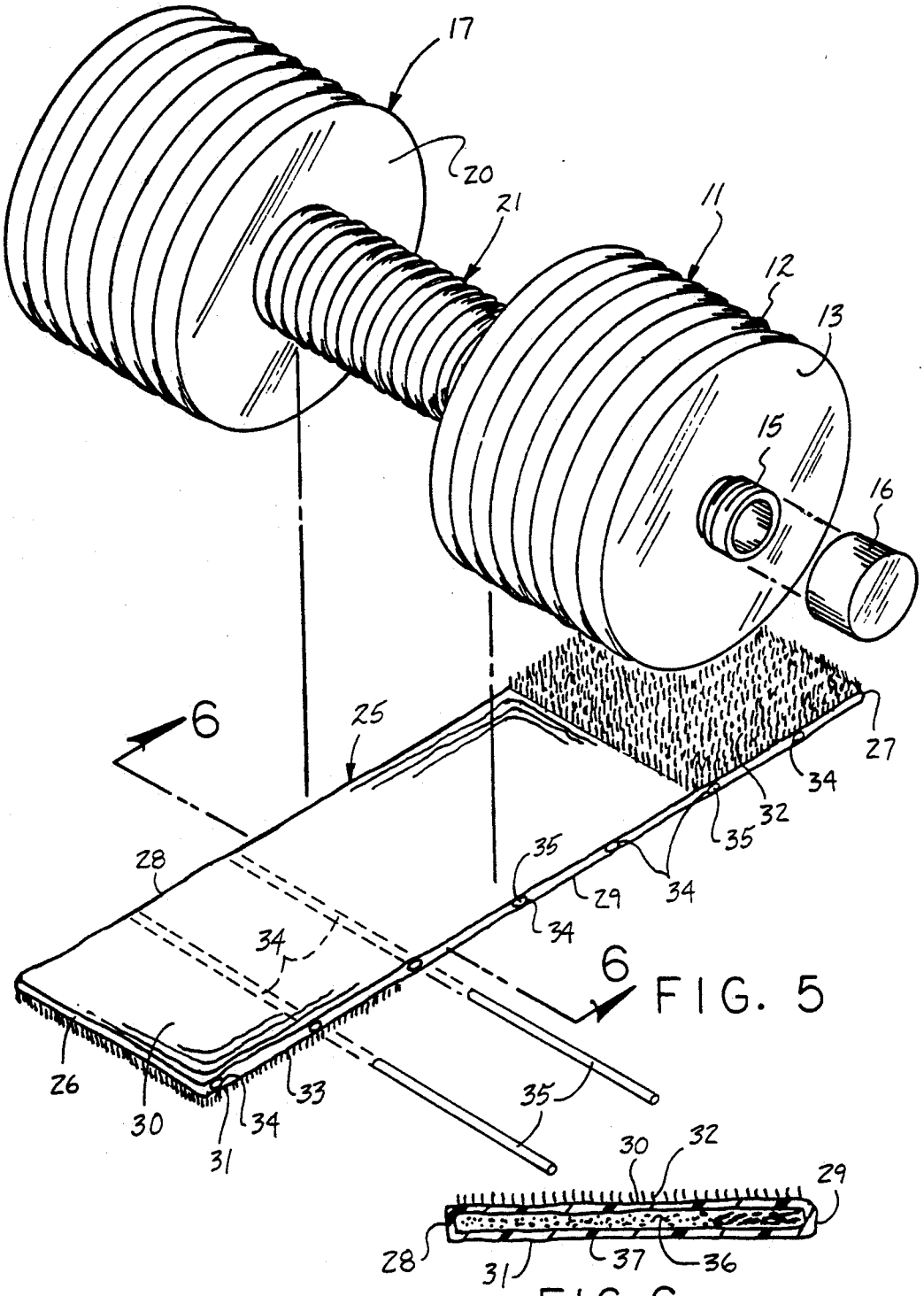
FIG. 5 is an isometric illustration in the use of a support web about the tubular housing of an associated dumbbell member.
FIG. 6 is an orthographic view, taken along the lines 6—6 of FIG. 5 in the direction indicated by the arrows.

More specifically, the apparatus 10 of the invention, as indicated in FIG. 2, configured as a dumbbell member comprises a first cylindrical housing 11 spaced from and coaxially aligned with a second cylindrical housing 17 about a predetermined axis 22, with a tubular housing 21 extending intermediate the first and second cylindrical housings 11 and 17. The first cylindrical housing includes an accordion pleated first housing side wall 12 permitting expansion and contraction of the first housing first end wall 13 towards and away from the first housing second end wall 14. A fill conduit 15 is directed through the first housing first end wall 13, having a cap member 16 removably mounted relative to the conduit 16, in a manner as indicated in FIG. 5. The cylindrical housing 17 includes an accordion pleated second housing side wall 18 arranged for extension and contraction relative to second housing first and second end walls 19 and 20 respectively, with the first housing first and second end walls 13 and 14 arranged in a parallel spaced relationship of a predetermined diameter, and the second housing first and second end walls 19 and 20 parallel to the end walls 13 and 14 of said predetermined diameter. The tubular housing 21 has a first end integrally and orthogonally mounted to the first housing second end wall, and the tubular housing second end secured to the second housing first end wall. The tubular housing includes a tubular housing accordion pleated side wall 23 arranged for extension and contraction as the first and second cylindrical housings 11 and 17, as well as the tubular housing 21, are formed of a flexible material permitting expansion and contraction of the first housing first end wall towards the second housing second end wall, in a manner as indicated in FIG. 3, for compaction of the organization during periods of storage and transport. A central cavity 24 extends coextensively from the first housing first end wall through the first housing, through the tubular housing, and extending through the second housing to the second housing second end wall 19.

The FIG. 5 indicates the use of a support web 25 having a web first end 26 spaced from a web second end 27, a web first side 28 spaced from a web second side 29, the web having a web top wall 30 and a web bottom wall 31. As the web is formed of a flexible material, the web is arranged for furling about the tubular housing 21 and accordingly, the tubular housing having a predetermined length substantially equal to a predetermined width of the support web 25 between the web first side 28 to the web second side 29. A first hook and loop fastener patch 32 is mounted on the web top wall 30 extending from the web second end 27, wherein a second hook and a lop fastener patch 33 mounted to the web bottom wall extends along the bottom wall from the web first end 26. The hook and loop fasteners 32 and 33 extend between the first and second sides 28 and 29. A plurality of spaced parallel tubular bores 34 are directed through the web orthogonally oriented relative to the web first side 28 to the web second side 29, with each of the tubular bores 34 arranged to receive a rigid rod 35. In this manner, upon furling of the web about the tubular housing 21, the rigid rods 35 impart rigidity in use of the organization maintaining alignment of the first and second cylindrical housing 11 and 17 relative to one another in use. Further, the web 25 defines an enclosable cavity 36 having a resilient sponge member 37 directed coextensively therewithin to impart ease and comfort in use and manipulation of the organization.

Figure 7:
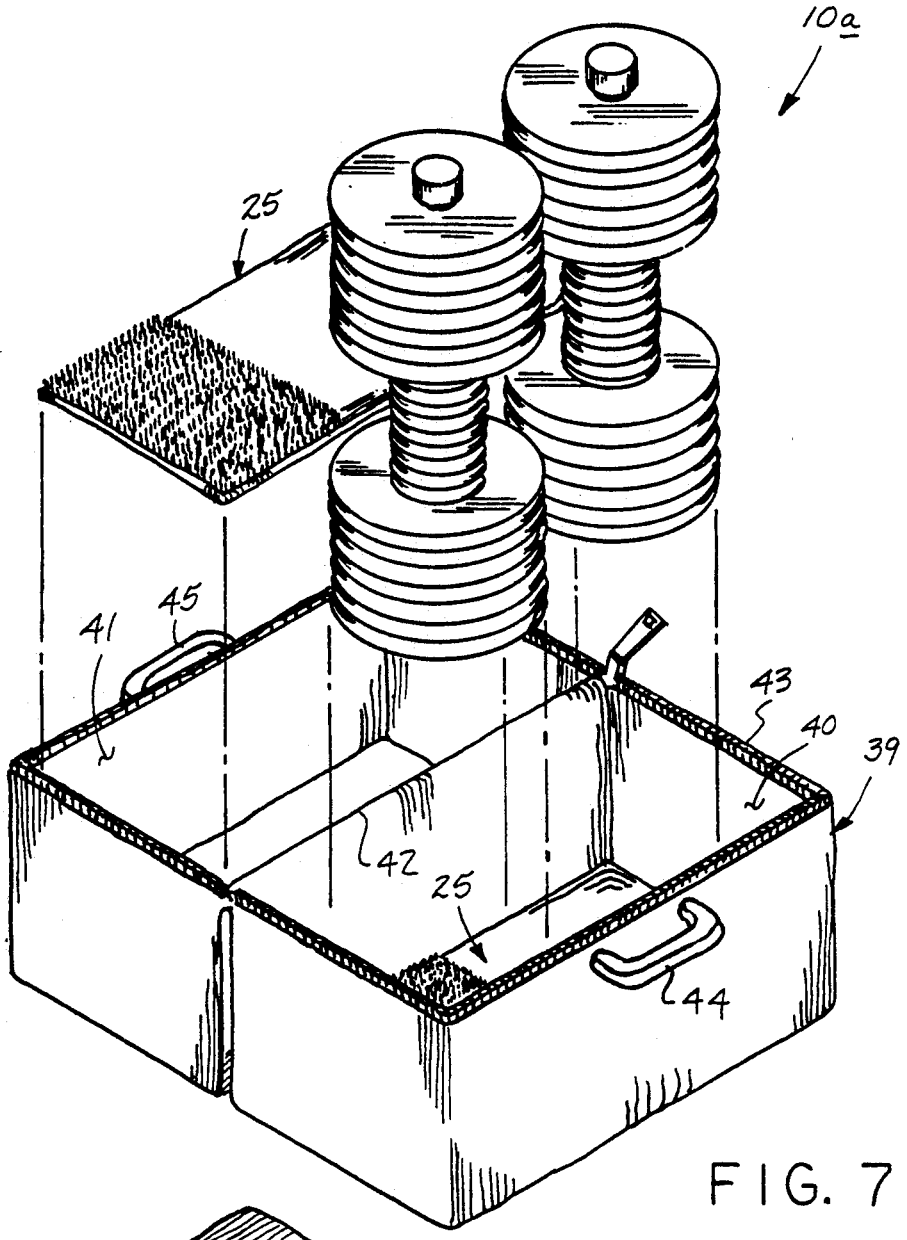
FIG. 7 is an isometric illustration of the apparatus indicated for use with a support container.
Figure 8:
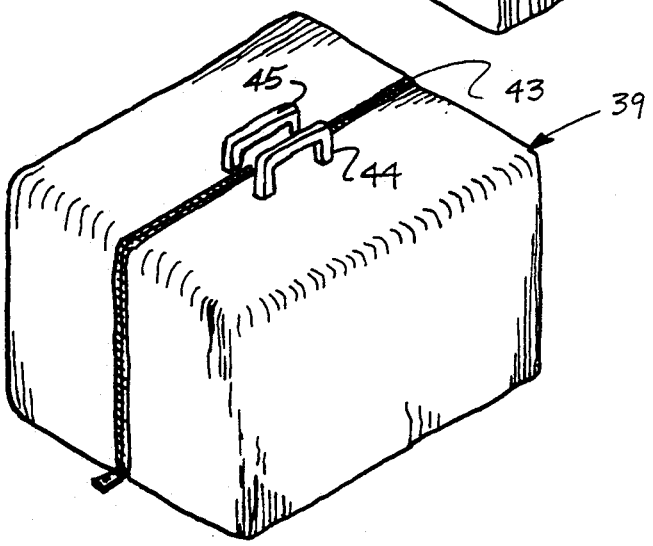
FIG. 8 is an isometric illustration of the support container arranged in a closed configuration for transport and storage of the dumbbell members positioned therewithin.

The FIGS. 7 and 8 indicates the use of a support container 39 indicated as the apparatus 10*a* to include a plurality of the dumbbell members, each of an identical configuration as indicated relative to the FIG. 2 for example. To this end, a plurality of support webs 25 are arranged for positioning within respective first and second cavities 40 and 41 of the support container 39 upon the first and second cavity floors. A connecting hinge 42 interconnects the support containers in a pivotal relationship, wherein a unitary zipper 43 is directed along the first and second cavities upper periphery that is continuous, whereupon a first handle 44 and a second handle 45 mounted to the container 39 adjacent the first and second cavities adjacent the continuous periphery at the zipper 43 are positioned in adjacency relative to one another for ease of manipulation and grasping of the organization when the dumbbell members, as well as the support webs are positioned within the support container, and the support container closed by means of the zipper 43 to transport the structure in a storage configuration.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable dumbbell apparatus, comprising, at least one dumbbell, wherein said at least one dumbbell includes a first cylindrical housing having a flexible, accordion pleated first housing side wall, and a second cylindrical housing having a flexible accordion pleated second housing side wall, and a tubular housing, having a tubular housing flexible accordion pleated side wall extending between the first cylindrical housing and the second cylindrical housing and the first cylindrical housing including fill means for introducing fluid or granular material into said dumbbell, and a support web, the support web including a web first end spaced from a web second end, a web first side spaced from a web second side, a web top wall spaced from a web bottom wall, wherein the support web is formed of a flexible material having an enclosed web cavity, including a resilient sponge member coextensive with the web cavity, and the support web includes a first hook and loop fastener patch mounted to the web wall extending along the web top wall from the web second end, and a second hook and loop fastener patch mounted to the web bottom wall extending along the web bottom wall extending from the web first end and the first hook and loop fastener patch and the second hook and loop fastener patch extend between the web first side and the web second side, wherein the first hook and loop fastener patch is arranged for securement to the second hook and loop fastener patch when the support web is furled about the tubular housing, and the support web includes a predetermined width between the web first side web second side, and the tubular housing includes a predetermined length extending between the first cylindrical housing and the second cylindrical housing, wherein the predetermined length is equal to the predetermined width, and a plurality of spaced parallel tubular bores directed into the web first side extending from the web first side through the web second side, with each of the tubular bores arranged to include a rigid rod to impart rigidity to the tubular housing when the support web is furled about the tubular housing.

2. An apparatus as set forth in claim 1 wherein the first cylindrical housing includes a first housing rigid first end wall spaced from and parallel a first housing rigid second end wall, the second cylindrical housing having a second housing rigid first end wall spaced from a rigid second housing second end wall, wherein the tubular housing extends between the first housing second end wall and the second housing first end wall, with the first cylindrical housing and the second cylindrical housing and the tubular housing symmetrically oriented about a predetermined axis, and the fill means includes a fill conduit directed therethrough, the fill conduit includes a cap member removably mounted relative to the fill conduit, and a central cavity extends through the first cylindrical housing, the tubular housing, and the second cylindrical housing in communication with the fill conduit.

3. An apparatus as set forth in claim 2 including a support container, the support container including a support container first cavity and a support container second cavity, wherein the first cavity is hingedly oriented relative to the second cavity about a connecting hinge medially of the support container, and including a further dumbbell member, wherein the at least one dumbbell member and the further dumbbell member are received within the first cavity, and a support web and a further support web are positioned within the first cavity, and the first cavity and the second cavity each include a continuous uppermost periphery having a zipper member mounted along the periphery, with a first handle mounted to the support container adjacent the first container and a second handle mounted to the support container in adjacency to the second cavity, wherein the first handle and the second handle are arranged for spaced adjacency relative to one another when the first container is directed against the second container about the hinge.

* * * * *